US010705446B2

(12) United States Patent
Hidaka et al.

(10) Patent No.: US 10,705,446 B2
(45) Date of Patent: Jul. 7, 2020

(54) IMAGE FORMING APPARATUS

(71) Applicant: FUJI XEROX CO., LTD., Tokyo (JP)

(72) Inventors: Keisuke Hidaka, Kanagawa (JP); Sho Watanabe, Kanagawa (JP)

(73) Assignee: FUJI XEROX CO., LTD., Tokyo (JP)

( * ) Notice: Subject to any disclaimer, the term of this patent is extended or adjusted under 35 U.S.C. 154(b) by 0 days.

(21) Appl. No.: 16/292,345

(22) Filed: Mar. 5, 2019

(65) Prior Publication Data

US 2020/0050125 A1 Feb. 13, 2020

(30) Foreign Application Priority Data

Aug. 10, 2018 (JP) ..... 2018-151291

(51) Int. Cl.

| | |
|---|---|
| ***G03G 21/16*** | (2006.01) |
| ***G03G 15/02*** | (2006.01) |
| ***G03G 15/01*** | (2006.01) |
| ***G03G 15/20*** | (2006.01) |

(52) U.S. Cl.

CPC ..... *G03G 15/025* (2013.01); *G03G 15/0142* (2013.01); *G03G 15/2039* (2013.01)

(58) Field of Classification Search

CPC ..... G03G 15/025; G03G 15/0142; G03G 15/2039

See application file for complete search history.

(56) References Cited

U.S. PATENT DOCUMENTS

2018/0249025 A1* 8/2018 Nakayama ..... H04N 1/00244

FOREIGN PATENT DOCUMENTS

JP 2016-206332 12/2016

* cited by examiner

*Primary Examiner* — David M. Gray
*Assistant Examiner* — Michael A Harrison
(74) *Attorney, Agent, or Firm* — JCIPRNET

(57) ABSTRACT

An image forming apparatus includes an information processing section that is provided with a housing and an image forming section that is disposed above the housing in a gravitational direction. In the image forming apparatus, a gap exists between the housing and the image forming section, and a ventilation hole is formed in an upper surface of the housing.

5 Claims, 9 Drawing Sheets

IMAGE FORMING APPARATUS

CROSS-REFERENCE TO RELATED APPLICATIONS

This application is based on and claims priority under 35 USC 119 from Japanese Patent Application No. 2018-151291 filed Aug. 10, 2018.

BACKGROUND

(i) Technical Field

The present disclosure relates to an image forming apparatus.

(ii) Related Art

Japanese Unexamined Patent Application Publication No. 2016-206332 describes an image forming apparatus including an image-forming-apparatus body, a recording medium accommodating section that accommodates a recording medium, a heating unit that is disposed above the recording medium accommodating section and that heats the inside of the image-forming-apparatus body, and a temperature detecting unit that detects the temperature of the heating unit. In the image forming apparatus, the temperature detecting unit is disposed at a high temperature portion of the recording medium accommodating section.

SUMMARY

In an image forming apparatus including an information processing section and an image forming section disposed above the information processing section, heat dissipation from the information processing section may be suppressed by the image forming section.

Aspects of non-limiting embodiments of the present disclosure relate to an image forming apparatus that is capable of accelerating heat dissipation from an information processing section compared to when a gap is not formed between the information processing section and an image forming section and a ventilation hole is not formed in an upper surface of a housing of the information processing section.

Aspects of certain non-limiting embodiments of the present disclosure address the above advantages and/or other advantages not described above. However, aspects of the non-limiting embodiments are not required to address the advantages described above, and aspects of the non-limiting embodiments of the present disclosure may not address advantages described above.

According to an aspect of the present disclosure, there is provided an image forming apparatus including an information processing section that is provided with a housing and an image forming section that is disposed above the housing in a gravitational direction. In the image forming apparatus, a gap exists between the housing and the image forming section, and a ventilation hole is formed in an upper surface of the housing.

BRIEF DESCRIPTION OF THE DRAWINGS

Exemplary embodiments of the present disclosure will be described in detail based on the following figures, wherein.

DETAILED DESCRIPTION

Figure 1:
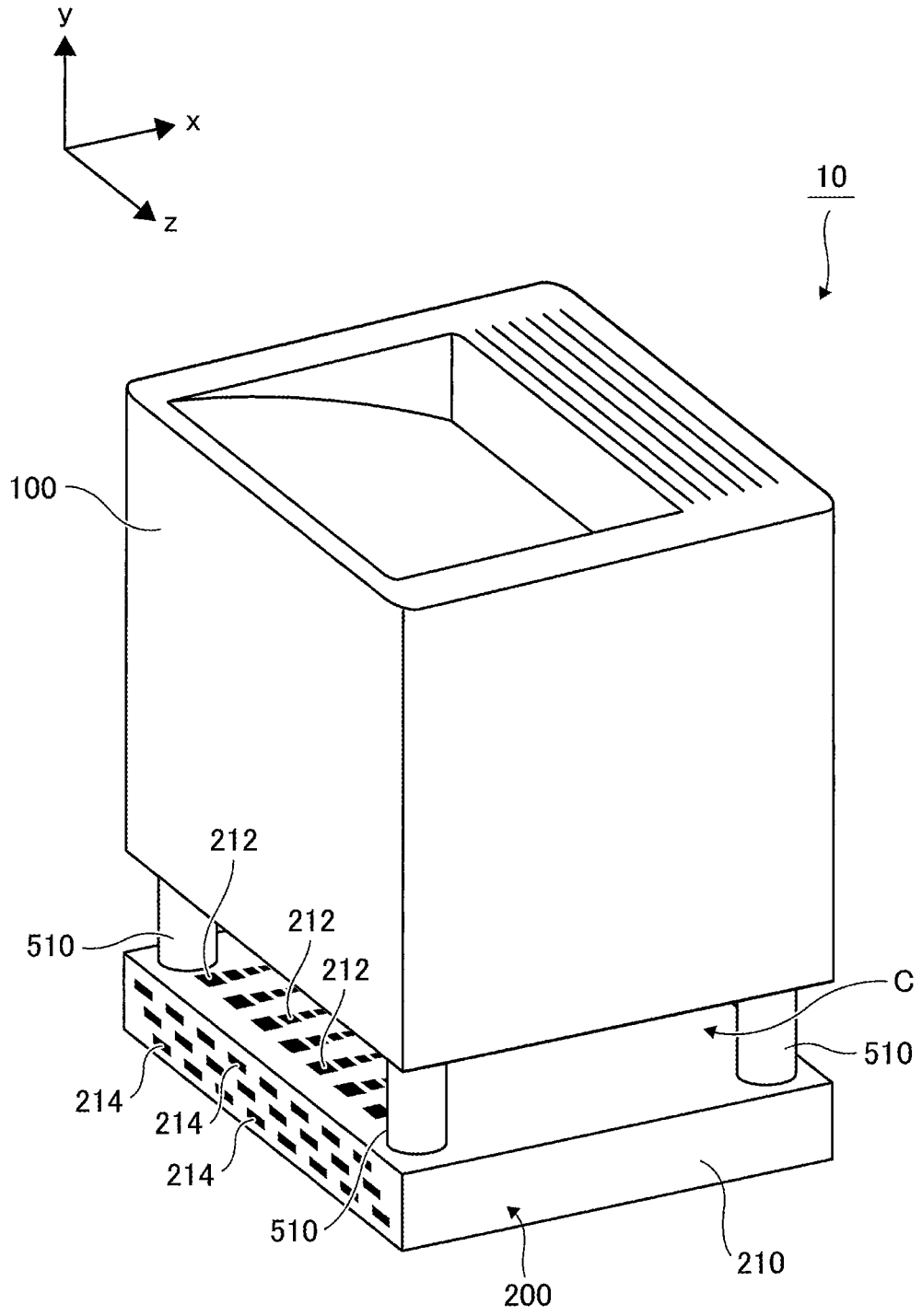
FIG. 1 is a perspective view of an image forming apparatus according to a first exemplary embodiment of the present disclosure.

Next, exemplary embodiments of the present disclosure are described with reference to the drawings. FIG. 1 illustrates an image forming apparatus 10 according to a first exemplary embodiment of the present disclosure. As illustrated in FIG. 1, the image forming apparatus 10 includes a server 200. The server 200 is an example of an information processing section and is provided with a housing 210.

The image forming apparatus 10 further includes an image forming section 100. The image forming section 100 is disposed above the server 200 in a gravitational direction. A gap C exists between the housing 210 and the image forming section 100. Ventilation holes 212 are formed in an upper surface of the housing 210. Ventilation holes 214 are formed in a front side surface of the housing 210. FIG. 1 schematically illustrates the ventilation holes 212, with the shapes, sizes, and arrangements of the ventilation holes 212 not being accurate. The details of the ventilation holes 212 are described below.

The image forming apparatus 10 further includes supporting portions 510. The supporting portions 510 are arranged in the gap C, and support a lower side of the image forming section 100 in the gravitational direction. The supporting portions 510 are supported on an upwardly facing surface of the housing 210. Although the image forming apparatus 10 includes four supporting portions 510, only three supporting portions 510 are shown in FIG. 1.

Figure 2:
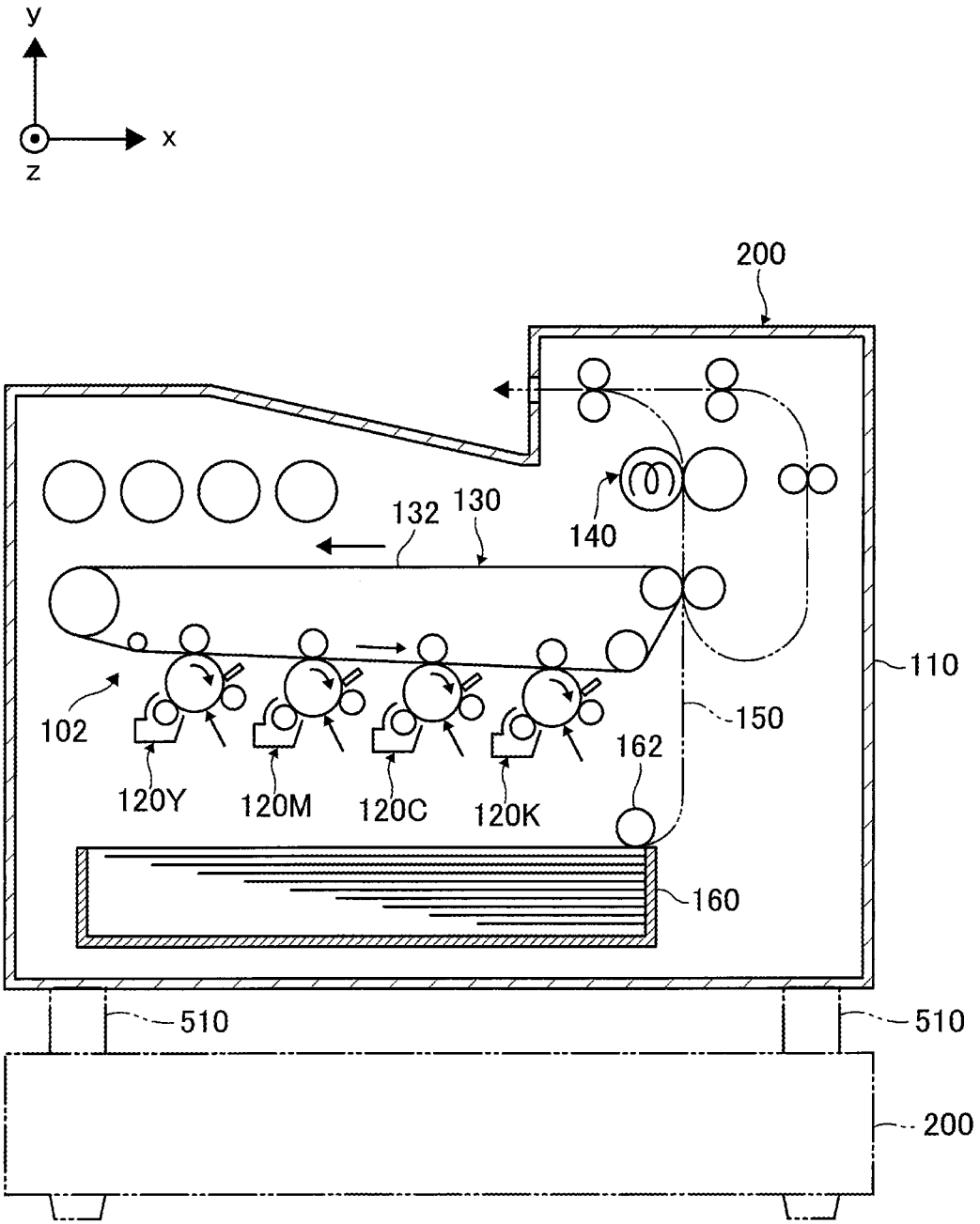
FIG. 2 is a sectional view of an image forming section of the image forming apparatus shown in FIG. 1.

FIG. 2 illustrates the image forming section 100. The image forming section 100 forms an image on, for example, a recording medium, such as ordinary paper. The image forming section 100 includes an image-forming-section body 110, and a toner image forming section 102 that is disposed in the image-forming-section body 110.

The toner image forming section 102 includes a unit 120Y that forms a yellow toner image, a unit 120M that forms a magenta toner image, a unit 120C that forms a cyan toner image, and a unit 120K that forms a black toner image.

The toner image forming section 102 further includes a transfer device 130. The transfer device 130 includes an intermediate transfer body 132, allows toner images formed by the respective units 120Y, 120M, 120C, and 120K to be transferred onto the intermediate transfer body 132, and allows the toner images transferred onto the intermediate transfer body 132 to be transferred onto a recording medium.

The image forming section 100 further includes a fixing device 140 that fixes the toner images transferred onto the recording medium to the recording medium.

A transport path 150 for transporting a recording medium is formed in the image-forming-section body 110.

An accommodating section 160 is further disposed in the image-forming-section body 110. The accommodating section 160 accommodates a recording medium to be supplied to the toner image forming section 102. A sending-out device 162 that sends out a recording medium accommodated in the accommodating section 160 towards the toner image forming section 102 is mounted on the accommodating section 160.

The accommodating section 160 is disposed above the server 200 in the gravitational direction and below the toner image forming section 102 in the gravitational direction.

Figure 3:
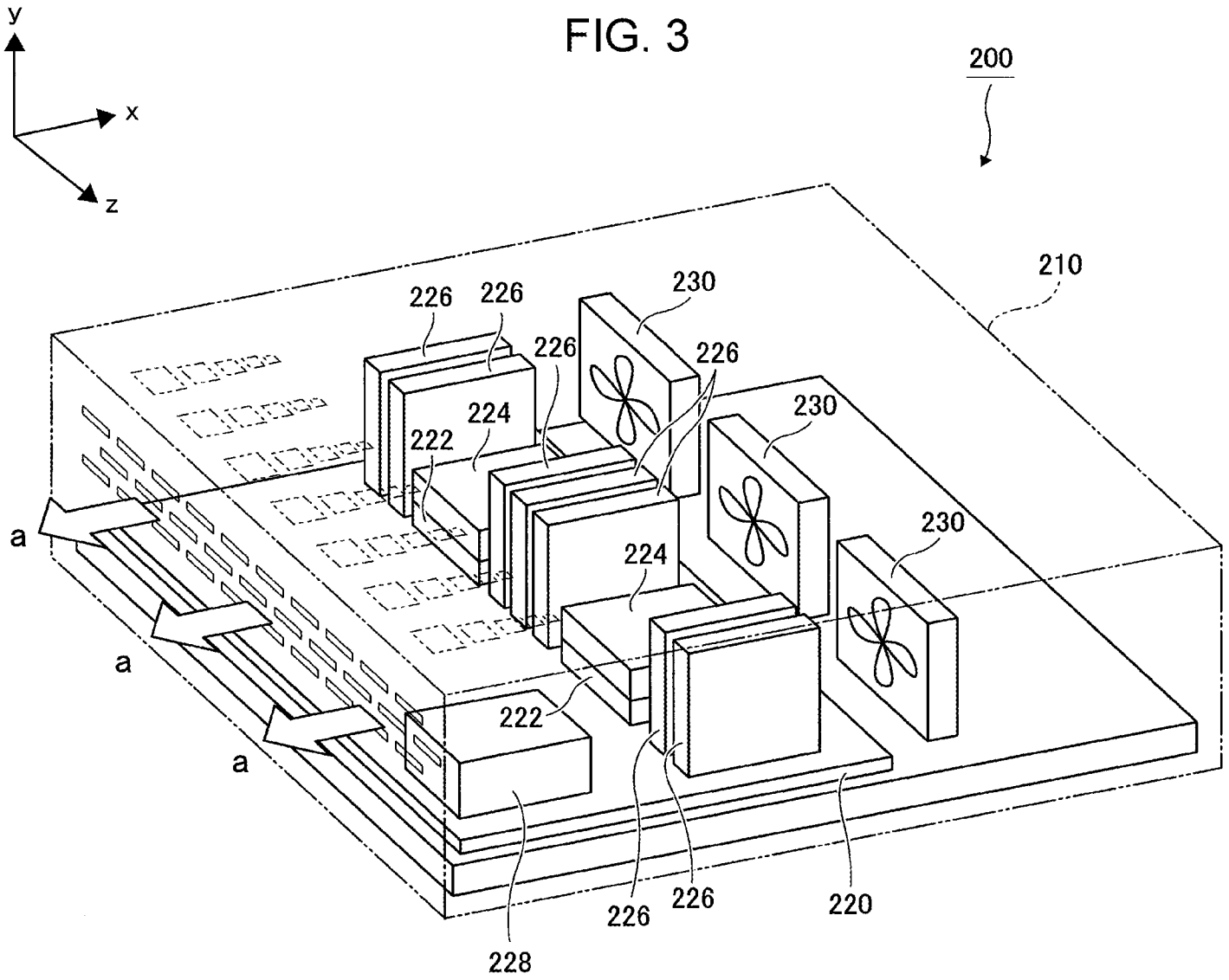
FIG. 3 is a perspective view of a server of the image forming apparatus shown in FIG. 1.
Figure 4:
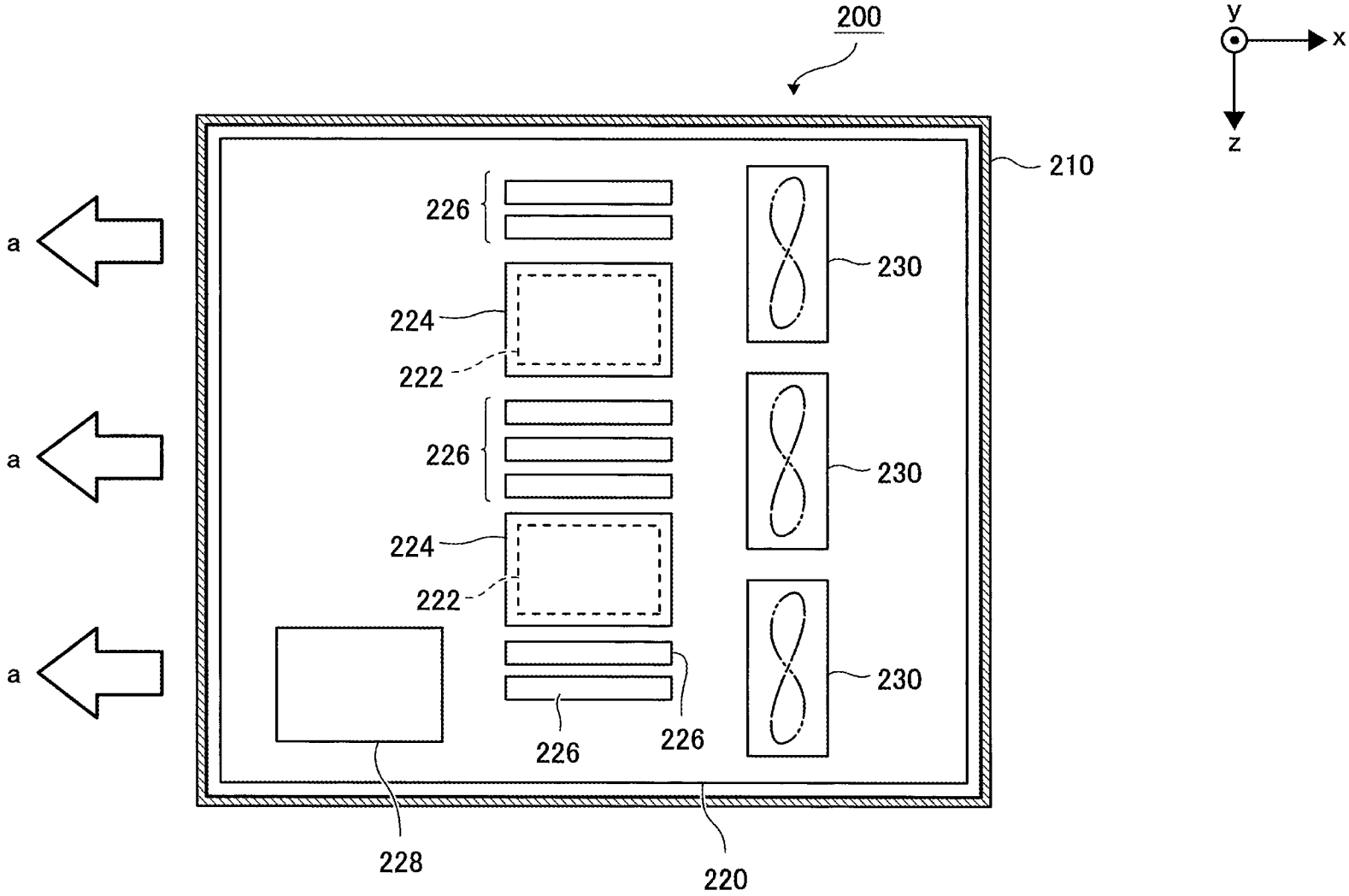
FIG. 4 is a sectional view of the server shown in FIG. 3.

FIGS. 3 and 4 illustrate the server 200. In FIG. 3, in order to illustrate the structure of the inside of the server 200, the housing 210 is indicated by an imaginary line. As shown in FIGS. 3 and 4, the server 200 includes a substrate 220. The substrate 220 is disposed in the housing 210.

The server 200 further includes processors 222. For example, two processors 222 are mounted on the substrate 220. Each processor 222 is an example of a heat generating section, and generates heat as each processor 222 computes.

The server 200 further includes heat sinks 224. Each heat sink 224 is disposed in the housing 210, and is an example of a heat dissipation accelerating section that accelerates heat dissipation. Here, "heat dissipation accelerating section" refers to a member that is made of a material having a thermal conductivity higher than the thermal conductivity of another member that the heating dissipation accelerating section contacts, and that accelerates heat dissipation from the other member that the heat dissipation accelerating section contacts and cooling of the other member that the heat dissipation accelerating section contacts. The material of each heat dissipation accelerating section is, for example, aluminum or copper. Each heat sink 224 is mounted on its corresponding processor 222 so as to contact an upper surface of its corresponding processor 222.

The server 200 further includes memories 226. Each memory 226 is an example of a recording medium on which data is recorded. For example, seven memories 226 are mounted on the substrate 220.

The server 200 includes a power supply 228. The power supply 228 is mounted on the substrate 220.

The server 200 further includes blowing fans 230. Each blowing fan 230 is an example of a blower. For example, three blowing fans 230 are disposed in the housing 210, and blow air in blowing directions indicated by arrows a in FIGS. 3 and 4.

Figure 5:
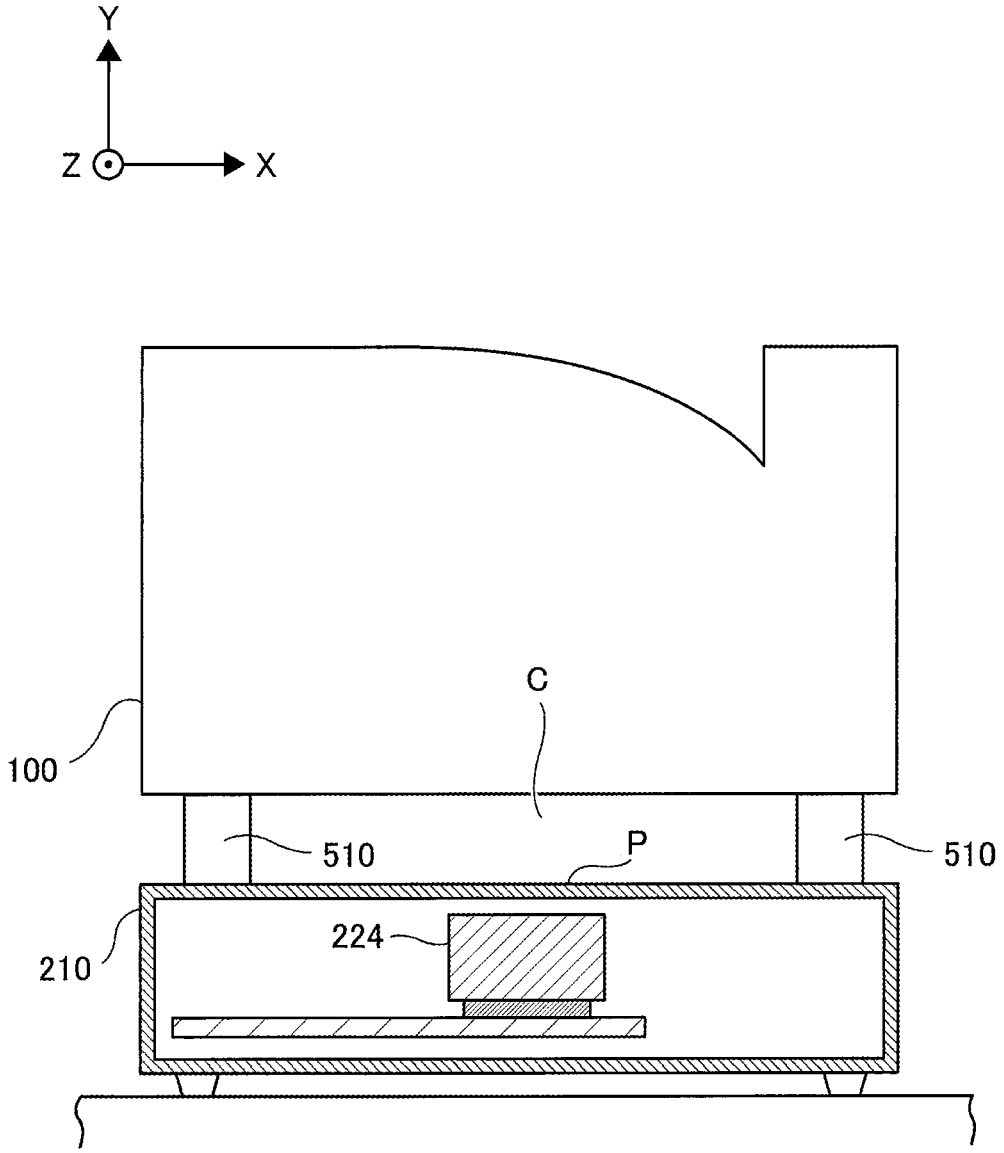
FIG. 5 illustrates a position of a gap of the image forming apparatus shown in FIG. 1.

FIG. 5 is a schematic view for describing the position of the gap C. As shown in FIG. 5, the gap C is formed at least between a position P on the housing 210 above the heat sinks 224 in the gravitational direction and the image forming section 100.

Figure 6:
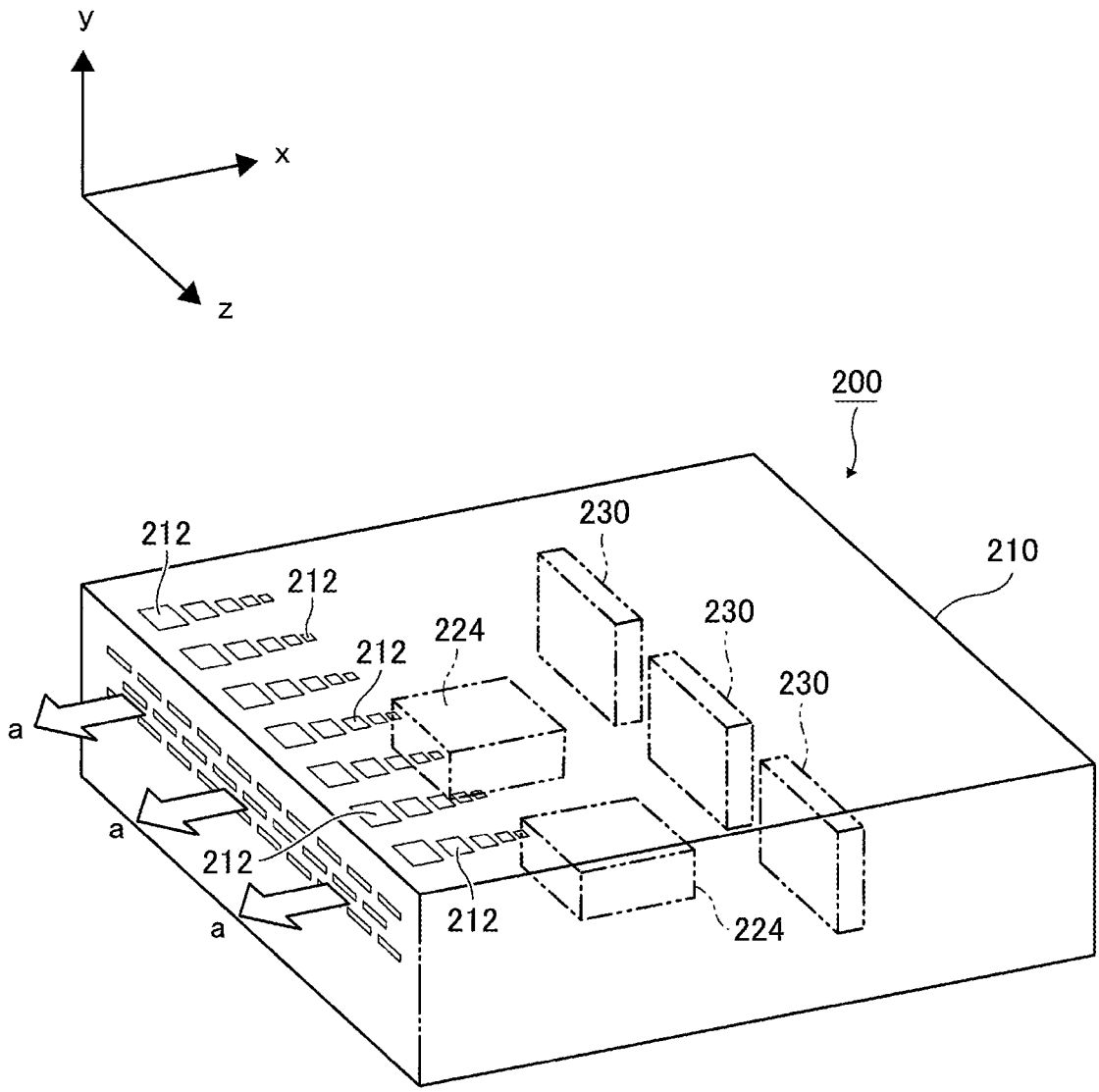
FIG. 6 illustrates ventilation holes in a housing of the server shown in FIG. 3.

FIG. 6 is a schematic view for describing the ventilation holes 212. As shown in FIG. 6, in the blowing directions, indicated by the arrows a, of the blowing fans 230 (hereunder referred to as the "blowing directions"), the ventilation holes 212 are formed on a downstream side of the blowing fans 230. In the blowing directions, the ventilation holes 212 are formed on a downstream side of the heat sinks 224. Further, in the blowing directions, the ventilation holes 212 may be formed so as to also overlap the heat sinks 224 or the blowing fans 230 or may be formed also on an upstream side of the heat sinks 224 or the blowing fans 230.

As shown in FIG. 6, the ventilation holes 212 are formed such that the opening area per unit area on the downstream side in the blowing directions is larger than the opening area per unit area on the upstream side in the blowing directions. Specifically, the area of each ventilation hole 212 located on the downstream side in the blowing directions is larger than the area of each ventilation hole 212 located on the upstream side in the blowing directions.

Here, in order to form the ventilation holes 212 such that the opening area per unit area on the downstream side in the blowing directions is larger than the opening area per unit area on the upstream side, the number of ventilation holes 212 per unit area on the downstream side may be larger than the number of ventilation holes 212 per unit area on the upstream side while the size of the ventilation holes 212 is a certain size. Alternatively, instead of gradually increasing the opening areas per unit area of the ventilation holes 212 from the upstream side to the downstream side in the blowing directions, for example, the opening areas per unit area of the ventilation holes 212 may be changed in stages, such as two stages.

Figure 7:
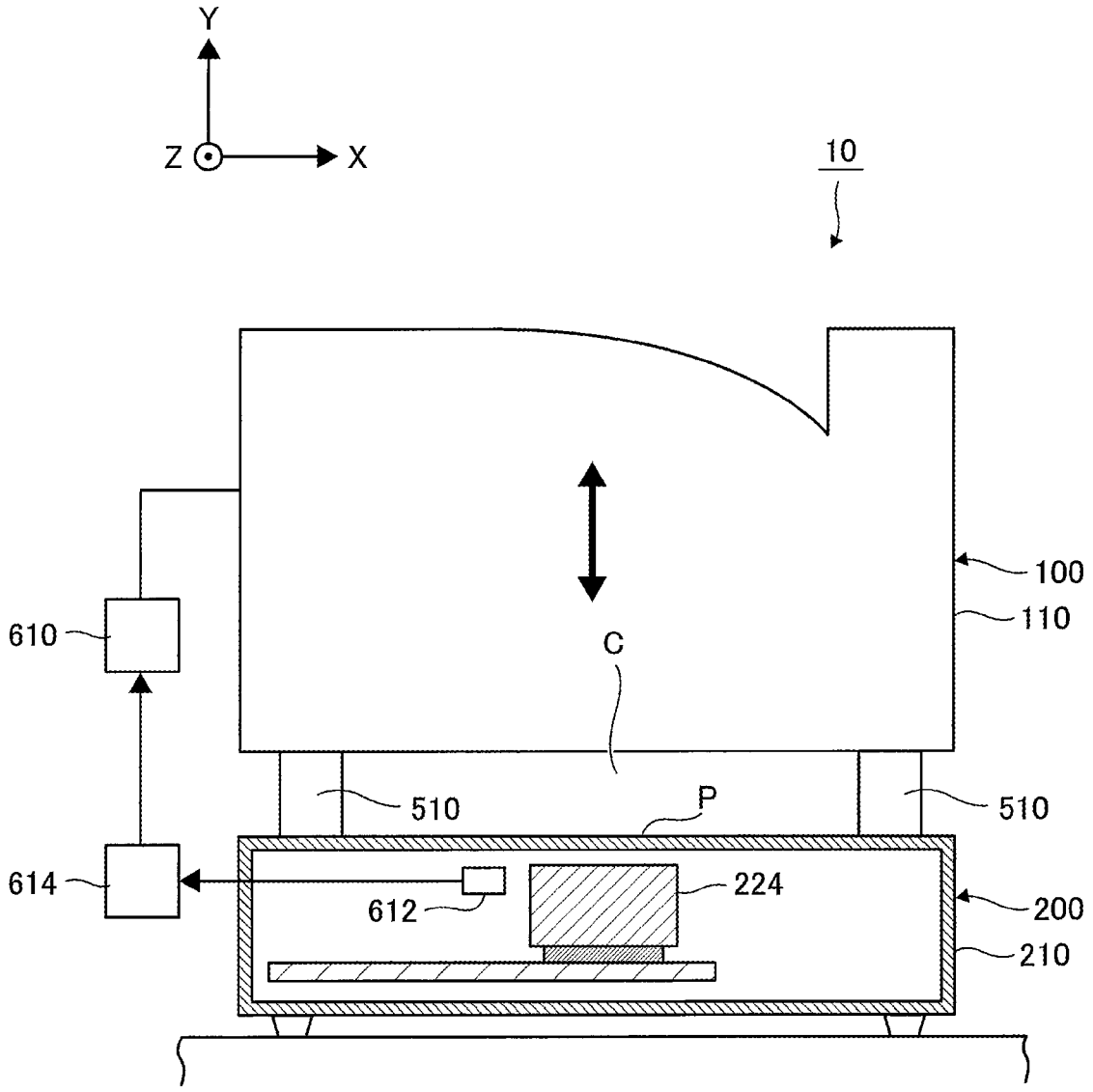
FIG. 7 illustrates an image forming apparatus according to a second exemplary embodiment of the present disclosure.

FIG. 7 illustrates an image forming apparatus 10 according to a second exemplary embodiment of the present disclosure. The image forming apparatus 10 of the second exemplary embodiment includes, in addition to all of the structures of the image forming apparatus 10 of the aforementioned first exemplary embodiment, a raising-lowering mechanism 610 that raises and lowers an image forming section 100 with respect to a server 200 in accordance with the inside temperature of the server 200.

The raising-lowering mechanism 610 is, for example, a hydraulic mechanism. On the basis of an output of a temperature detection sensor 612 that detects the inside temperature of a housing 210, the raising-lowering mechanism 610 is controlled by a controller 614. Specifically, the raising-lowering mechanism 610 is controlled such that, when the inside temperature of the housing 210 reaches 25° C., the raising-lowering mechanism 610 raises the image forming section 100 by 50 mm from a prescribed position; when the inside temperature of the housing 210 reaches 30° C., the raising-lowering mechanism 610 raises the image forming section 100 by 100 mm from the prescribed position; and when the inside temperature of the housing 210 reaches 35° C., the raising-lowering mechanism 610 raises the image forming section 100 by 200 mm from the prescribed position.

Figure 8:
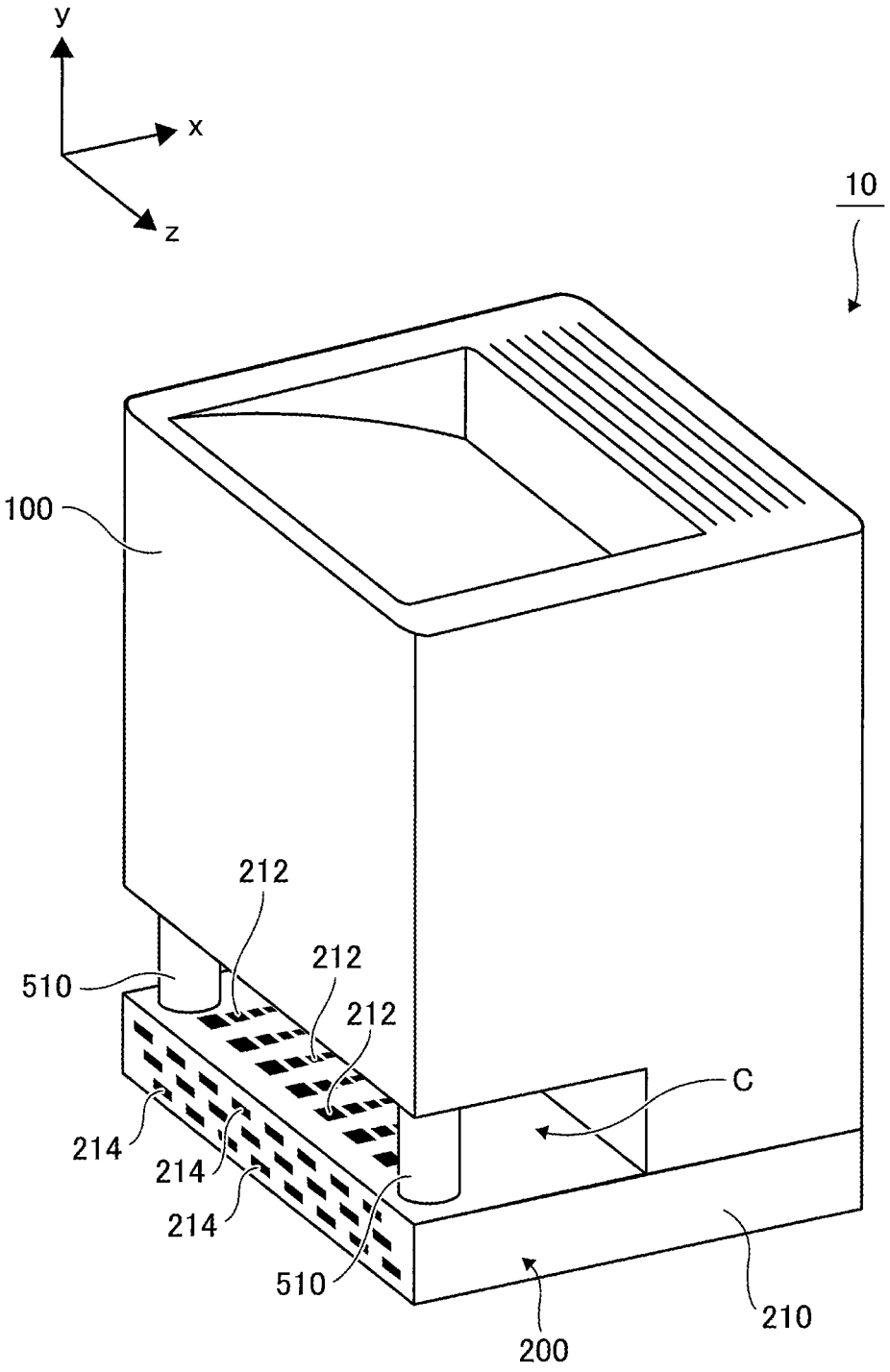
FIG. 8 is a perspective view of an image forming apparatus according to a third exemplary embodiment of the present disclosure.
Figure 9:
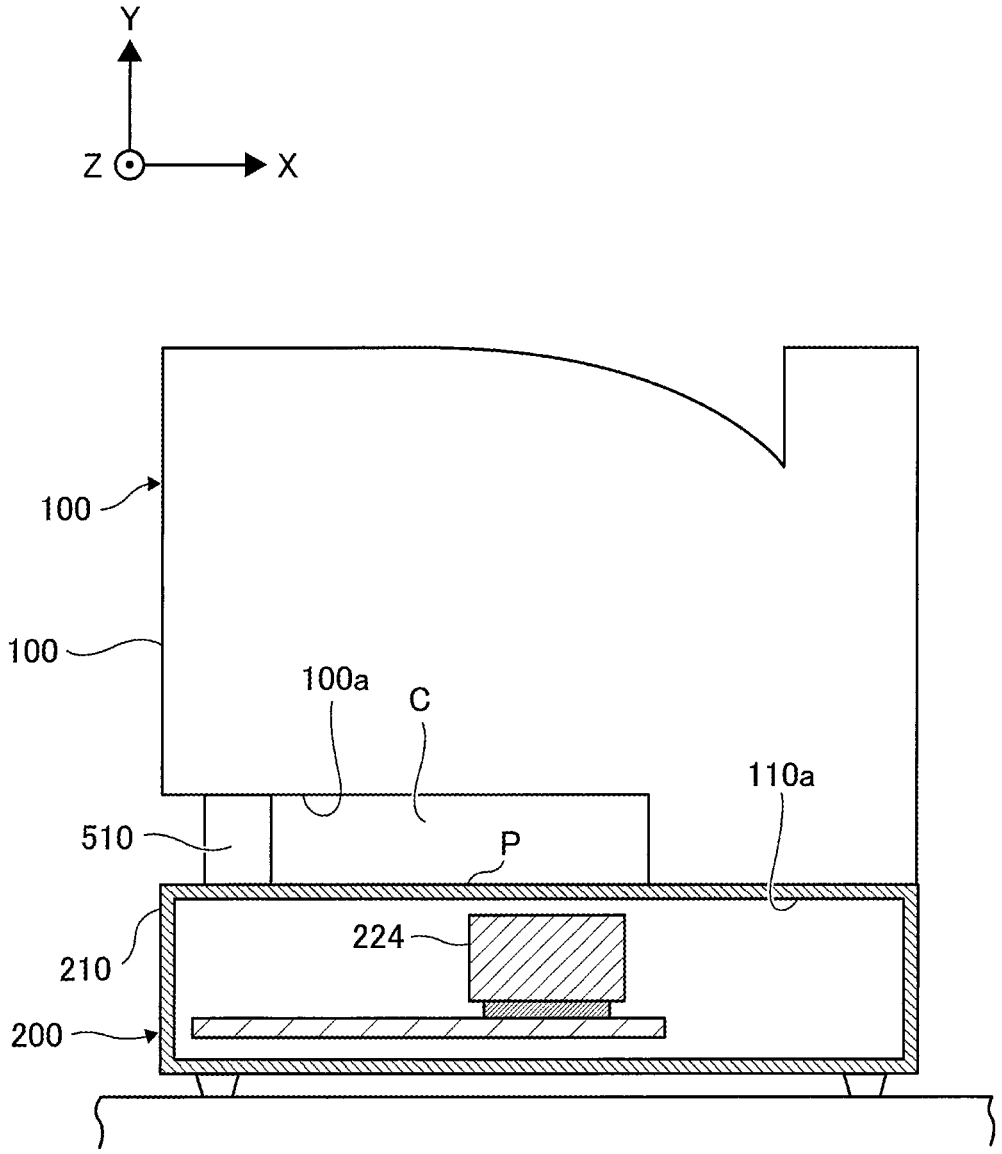
FIG. 9 is a sectional view of a part of the image forming apparatus shown in FIG. 8.

FIGS. 8 and 9 illustrate an image forming apparatus 10 of a third exemplary embodiment of the present disclosure. In the image forming apparatus 10 of the aforementioned first exemplary embodiment, the image forming section 100 is supported on the upper surface of the housing 210 by four supporting portions 510, and the gap C is formed between the housing 210 and the image-forming-section body 110 with the upper surface of the housing 210 and a bottom surface 110*a* of the image-forming-section body 110 being out of contact with each other. In contrast, in the third exemplary embodiment, an upper surface of a housing 210 and a part of a bottom surface 110*a* of an image-forming-section body 110 are in contact with each other, and the image-forming-section body 110 is supported on the upper surface of the housing 210 by this part of the bottom surface 110*a* of the image-forming-section body 110 and by, for example, two supporting portions 510. A gap C is formed between the housing 210 and a portion of the bottom surface 110*a* of the image-forming-section body 110 that does not contact the housing 210.

Even in the third exemplary embodiment, as in the aforementioned first exemplary embodiment, the gap C is formed so as to be formed at least between a position P on the housing 210 above heat sinks 224 in the gravitational direction and an image forming section 100. Since, excluding the above-described portions, the image forming apparatus 10 of the third exemplary embodiment has the same structure as the image forming apparatus 10 of the aforementioned first exemplary embodiment, the portions having the same structures are not described.

The foregoing description of the exemplary embodiments of the present disclosure has been provided for the purposes of illustration and description. It is not intended to be exhaustive or to limit the disclosure to the precise forms disclosed. Obviously, many modifications and variations will be apparent to practitioners skilled in the art. The embodiments were chosen and described in order to best explain the principles of the disclosure and its practical applications, thereby enabling others skilled in the art to understand the disclosure for various embodiments and with the various modifications as are suited to the particular use contemplated. It is intended that the scope of the disclosure be defined by the following claims and their equivalents.

What is claimed is:

1. An image forming apparatus comprising:

an information processing section that is provided with a housing; and an image forming section that is disposed above the housing in a gravitational direction defined as a direction from the image forming section to the information processing section, wherein a gap exists at least between a position on the housing above a heat dissipation accelerating section in the gravitational direction and the image forming section, and a ventilation hole is formed in an upper surface of the housing, wherein the ventilation hole is formed on a downstream side of the blower and the heat dissipation accelerating section in a blowing direction of the blower, wherein the ventilation hole is formed such that an opening area per unit area on the downstream side in the blowing direction is larger than an opening area per unit area on an upstream side in the blowing direction, wherein the information processing section is disposed in the housing and comprises a blower and the heat dissipation accelerating section that accelerates heat dissipation, and the heat dissipation accelerating section is located at the downstream side of the blower in the blowing direction of the blower.

2. The image forming apparatus according to claim 1, further comprising a supporting portion that is disposed in the gap and that supports a lower side of the image forming section in the gravitational direction.

3. The image forming apparatus according to claim 1, wherein the image forming section includes a toner image forming section that forms a toner image on a recording medium; and an accommodating section that accommodates the recording medium that is supplied to the toner image forming section, and wherein the accommodating section is disposed above the information processing section in the gravitational direction and below the toner image forming section in the gravitational direction.

4. An image forming apparatus comprising:

an information processing section that is provided with a housing; and an image forming section that is disposed above the housing in a gravitational direction defined as a direction from the image forming section to the information processing section, wherein a gap exists between the housing and the image forming section, and a ventilation hole is formed in an upper surface of the housing, wherein the information processing section includes a blower that is disposed in the housing, and wherein the ventilation hole is formed on a downstream side of the blower in a blowing direction of the blower, wherein the ventilation hole is formed such that an opening area per unit area on the downstream side in the blowing direction is larger than an opening area per unit area on an upstream side in the blowing direction.

5. The image forming apparatus according to claim 4, further comprising a supporting portion that is disposed in the gap and that supports a lower side of the image forming section in the gravitational direction.

* * * * *